US005644114A

United States Patent [19]

Neaves

[11] Patent Number: 5,644,114

[45] Date of Patent: Jul. 1, 1997

[54] PLURAL SWITCH ARRANGEMENT INCLUDING SHIFTER CAM FOR CHILDREN'S RIDE-ON VEHICLES

[75] Inventor: Patrice M. Neaves, Ft. Wayne, Ind.

[73] Assignee: Mattel, Inc., El Segundo, Calif.

[21] Appl. No.: 497,821

[22] Filed: Jul. 3, 1995

[51] Int. Cl.[6] ..... H01H 3/00; H01H 21/80

[52] U.S. Cl. ..... 200/6 R; 200/6 B; 200/18

[58] Field of Search ..... 200/1 R, 5 R, 200/6 R, 6 B, 17 R, 18, 61.85, 61.88, 339

[56] References Cited

U.S. PATENT DOCUMENTS

| | | | |
|---|---|---|---|
| 3,657,493 | 4/1972 | Horsley | 200/6 B |
| 3,995,579 | 12/1976 | Childre | 440/7 |
| 4,052,578 | 10/1977 | Hoke | 200/574 |
| 4,088,852 | 5/1978 | Van Doren | 200/18 X |
| 4,132,128 | 1/1979 | Roggenkamp | 74/527 |
| 4,639,646 | 1/1987 | Harris et al. | 318/139 |
| 4,736,648 | 4/1988 | Perego | 74/474 |
| 5,173,591 | 12/1992 | Perego | 200/61.88 |
| 5,237,302 | 8/1993 | Harris | 337/4 |
| 5,315,221 | 5/1994 | Corey | 318/434 |

*Primary Examiner*—J. R. Scott

*Attorney, Agent, or Firm*—Kolisch, Hartwell, Dickinson, McCormack & Heuser

[57] ABSTRACT

A shifter design for a child's ride-on vehicle is described. The shifter allows for selection of various speeds and directions while precluding the selection of undesirable speeds and directions. Preferably the shifter includes a housing mounted on the body of the vehicle, a speed and direction switch mounted on the housing and an actuator on the housing for selectively contacting the switches. The switches are conventional rocker switches pivotable about a central axis to two settings. In the preferred embodiment, the actuator is pivotally mounted to the housing and a depending selection member with longitudinally-spaced annular structure pivots about an axis generally perpendicular to the pivot axes of the switches to contact the switches. In other embodiments, the actuator is slidably mounted to the housing. The rocker switches are provided with concave contact surfaces to ensure the desired speed and direction are selected.

11 Claims, 3 Drawing Sheets

PLURAL SWITCH ARRANGEMENT INCLUDING SHIFTER CAM FOR CHILDREN'S RIDE-ON VEHICLES

BACKGROUND AND SUMMARY OF THE INVENTION

The present invention relates generally to children's ride-on vehicles. More specifically, the invention concerns a simplified shifter design which allows a child to select between varying speeds and directions such as high speed forward and low speed forward and reverse. The invention mechanically precludes the selection of undesirable speeds and directions, such as high speed reverse.

In the last few years, ride-on vehicles having motors, intended for use by children have become popular toys. These toys come in many shapes and sizes depending on the age and size of a particular child. Typically, the ride-on vehicles will have a battery source connected to an electric motor which drives one or more of the vehicle's wheels according to the speed and direction selected by the child.

To operate the vehicle, a child will sit on or within the vehicle, and by pressing a pedal or moving a switch on a control panel, the vehicle's motor is energized by the battery source and the vehicle is driven by the child in much the same way an adult operates an automobile.

Most vehicles have more than one speed and several have more than one direction. In vehicles having more than one speed, there is usually a fast and a slow speed. In vehicles having more than one direction, the second direction is usually reverse.

It is well known that a high speed reverse mode is undesirable because a child cannot see where they are going. Conventional attempts have been made to eliminate this setting or reduce the chances of inadvertently selecting it. One such attempt is U.S. Pat. No. 5,173,591 to Perego which discloses a gear shift connected to two rotatable elements. The rotatable elements have a spring therebetween and are designed to selectively contact a speed and direction switch, which in turn select connections between an electric motor and a set of batteries to achieve multiple running modes. Perego precludes a high speed/reverse mode by allowing reverse to be selected only when the speed switch is in the low position and the force of a spring acting between the rotatable elements is overcome by a rider moving the shift. Thus, to enable only a low speed/reverse mode, Perego employs: two different types of switches (one having two fixed positions and one having only one fixed position), two rotatable elements, and a spring acting therebetween.

While it is desirable to preclude the high speed reverse mode, it is also desirable to reduce the number of elements and moving parts necessary to do so and to provide a design which is inexpensive to manufacture and easy to assemble. The design must be durable enough to withstand the often times destructive way that a child uses the vehicle. It is also desirable to provide a ride-on toy in which the high/forward setting can be disabled until the child learns how to correctly and safely operate the vehicle at slower speeds.

With the above problems in mind, a general object of this invention is to provide a child's ride-on vehicle which has a shifter design connected between a power source and a motor source which enables a child to select between desired speeds and directions and precludes the selection of undesired speeds and directions.

It is another object of this invention to provide a housing and shifter design which may be used in a child's ride-on vehicle to enable a child to select between a high/forward, a low/forward and a low/reverse mode of operation while precluding the selection of a high/reverse mode.

Another object of the invention is to provide a shifter design which is inexpensive to manufacture and durable enough to withstand the use to which it may be put by a child.

The invention achieves these and other objects in the form of a simplified shifter which reduces the number of components necessary, utilizes the same type of switch for both the direction and speed control, and provides for a switch contact surface which complements the structure of a gear actuator or selector to ensure that the desired mode is selected.

The shifter design in the preferred embodiment of the invention features a housing or casing on which two rocker switches are housed: a high/low switch and a forward/reverse switch. The switches are connected between a battery source and plural motors and are adjacent one another. An actuator or shifter is pivotally mounted to the housing and moved in a plane parallel to the pivot axes of the switches. The actuator has a depending selection member with longitudinally-spaced annular structure for selectively contacting the switches upon movement of the shifter by the rider. The high/forward setting corresponds to a parallel connection between the plural motors and the low/forward and low/reverse settings correspond to a series connection between the plural motors. The switches are positioned to preclude a high/reverse setting. Hence, a child riding on the toy in which the shifter is configured, may select between only three distinct modes of operation: high/forward, low/forward and low/reverse. Further, a removable stop element is provided and may be used by an adult to prevent the child from selecting the high/forward mode, until the child learns to control the vehicle at lower speeds.

In an alternative embodiment of the invention, the shifter features an actuator slidably mounted to the housing adjacent the speed and direction switches. The actuator slides in a path generally parallel to the pivot axes of the speed and direction switches and includes an elongate selection member, transverse the slide path of the actuator, for selectively contacting the switches.

These and additional objects and advantages of the present invention will be more readily understood after a consideration of the drawings and the detailed description of the preferred and alternative embodiments.

DETAILED DESCRIPTION OF THE PREFERRED EMBODIMENT

Figure 1:
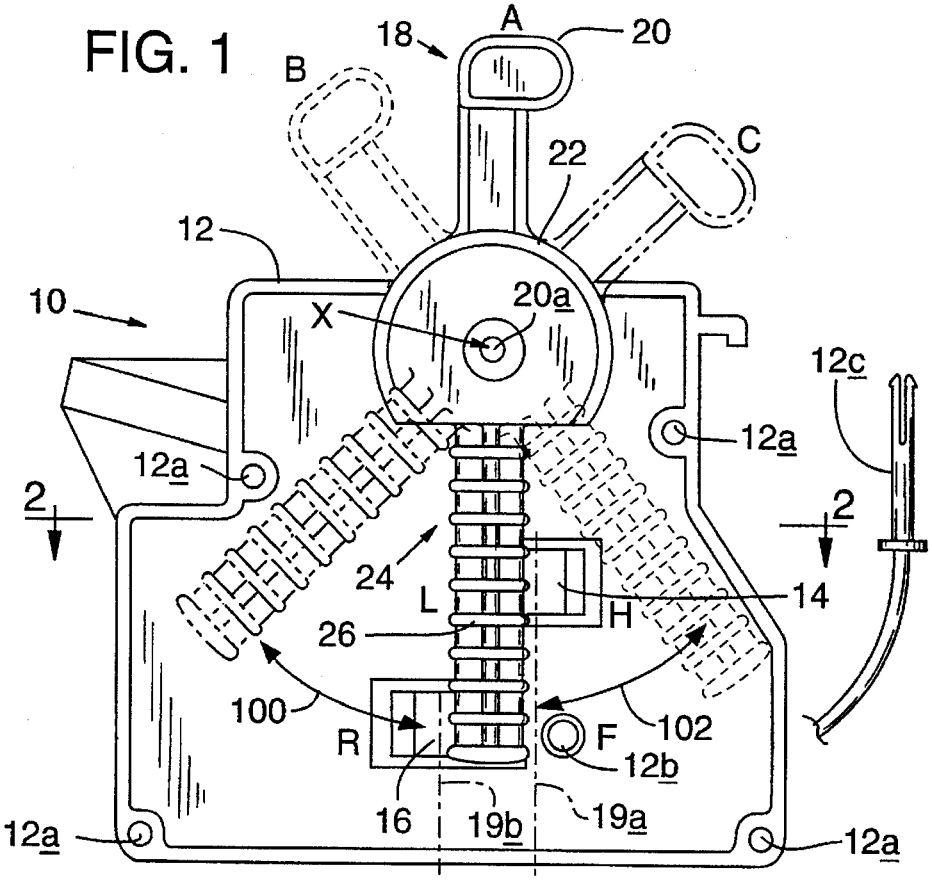
FIG. 1 is a side-plan view of the shifter according to the preferred embodiment, with a portion of the housing removed to show detail.

FIG. 1 shows a housing and shifter assembly unit according to the preferred embodiment generally at 10 where it may be seen to include a housing preferably of molded plastic, half of which is shown at 12, with two double-pole, double-throw rocker switches 14, 16 located thereon. The mated portion of housing 12 (not shown) is joined by screws received in peripherally disposed screw apertures 12*a*. Switches 14, 16 are mounted on housing 12 by snapping them into openings in the housing (not shown) and are movable about pivot axes 19*a*, 19*b* respectively to two separate settings.

Figure 6:
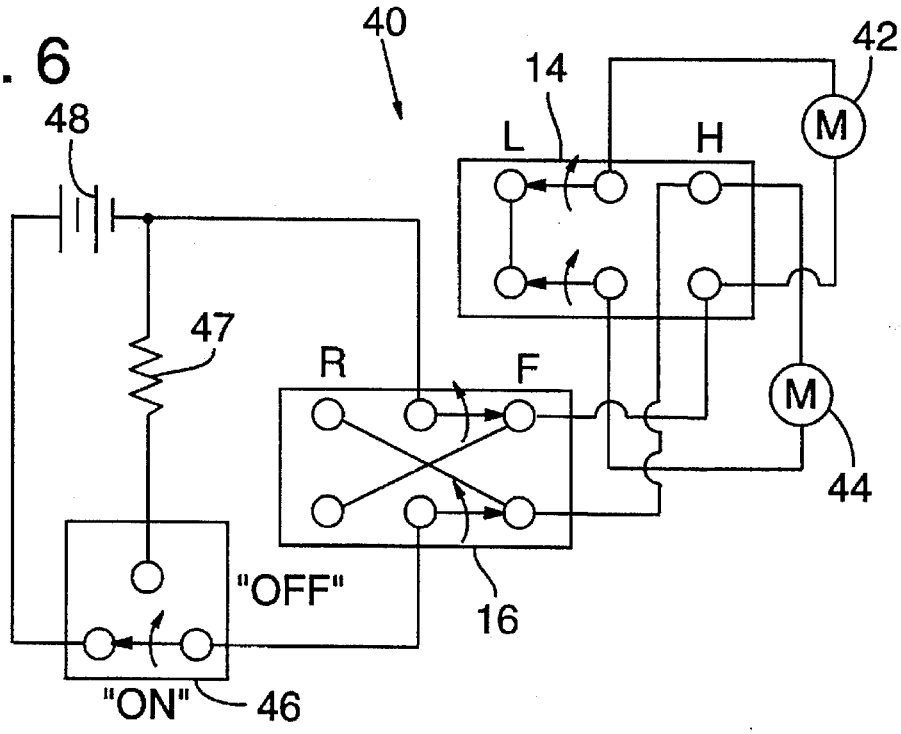
FIG. 6 is a schematic diagram of the electrical system of the present invention.

Switch 14 is a speed switch and is movable about pivot axis 19*a* between a high (H) and a low (L) setting. Switch 16 is mounted adjacent switch 14 and is a direction switch which is movable about pivot axis 19*b* between a forward (F) and a reverse (R) setting. Switches 14, 16 control settings in an electrical circuit which is shown in FIG. 6 and is designed to be employed in a child's riding vehicle having a battery source and a motor source. Although pivot axes 19*a*, 19*b* are preferably parallel as shown, the switches could be relocated on housing 12 so that the axes would be angularly offset from one another or even collinear without departing from the spirit and scope of the invention.

A gear actuator shown generally at 18, is preferably formed from molded plastic and suitably mounted on housing 12 and the mated portion thereof, so as to be pivotable in relation thereto, adjacent switches 14, 16. Actuator 18 includes a handle 20 with a neck which extends downwardly therefrom and is joined to a hub 22. In the preferred embodiment, housing 12 and its mated portion include wells formed during the molding process, and actuator 18 includes two detents on either side thereof, one of which is shown at 20*a*, which are insertable into a corresponding well for enabling the actuator to be pivoted between operational settings described in more detail below. Actuator 18 includes a generally downwardly-extending elongate selection member 24 adjacent hub 22, which includes plural, spaced annular structure, one of which is designated at 26. Actuator 18 is pivotable about an axis X which is defined by detent 20*a* and extends into the plane of FIG. 1. As shown, axis X is generally perpendicular to axes 19*a* and 19*b*. Put another way, actuator 18 is movable in a plane (arrows 100, 102 lying in that plane) which is generally parallel to pivot axes 19*a* and 19*b*. Selection member 24, and more specifically the longitudinally-spaced annular structure thereon slide along concave contact surfaces 14*a*, 16*a* (FIG. 2A) of switches 14, 16 when actuator 18 is moved or pivoted in the direction of arrows 100 and 102 in FIG. 1, thus ensuring that the desired electrical connection and hence running mode is selected.

FIG. 1 shows actuator 18 pivoted between three separate positions A, B, and C. Position A is a first contact position and corresponds to a low/forward setting, position B represented by the dashed lines, is a second contact position and corresponds to a high/forward setting, and position C represented by the dashed-double-dot lines is a third contact position and corresponds to a low/reverse setting. As a child moves handle 20, and hence selection member 24 in the direction of arrows 100 and 102 in FIG. 1, gear actuator 18 pivots bringing selection member 24, and more specifically annular structure 26 into sliding contact with concave contact surfaces 14*a*, 16*a* of switches 14, 16 respectively. By doing so, the switches may be set to achieve the three running settings described above. A high/reverse setting is mechanically precluded because it is impossible to place selection member 24 in a position to select both a high speed and a reverse direction. Moreover, a stop element 12*c* is insertable into aperture 12*b* to prevent a child from moving actuator 18 to the high/forward setting until safe vehicle operation is learned at slower speeds. Such stop element could be a screw or a pin, but in the preferred embodiment is a two-pronged stop element. Further, aperture 12*b* is preferably chamfered for engaging the element's prongs and blocking the selection member from being moved to the high/forward setting. It will be appreciated that element 12*c* is connected to the half of housing 12 which is not shown so that the element will not become misplaced, and that the element is shown in FIG. 1 disconnected from the mated portion of housing 12 for illustrative purposes only.

Figure 2A:
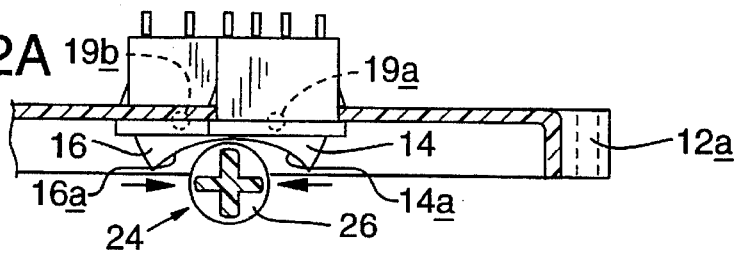
FIGS. 2A, 2B, and 2C, are top-sectional views of the shifter, taken generally along line 2—2 in FIG. 1 showing three different positions to which the shifter may be set.
Figure 2B:
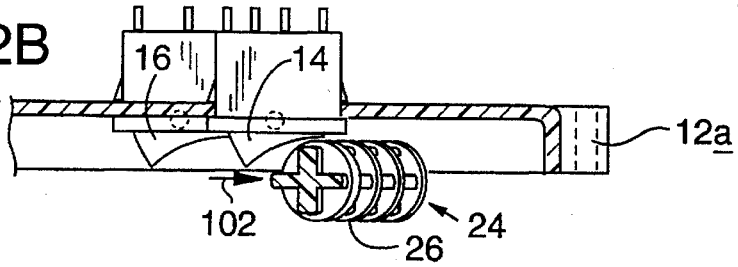
Figure 2C:
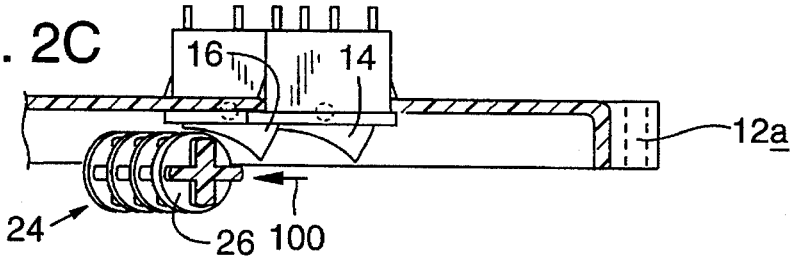

Shown collectively in FIGS. 2A, 2B, and 2C, are top views of switch settings A, B, and C discussed above. That is, FIG. 2A is a top view of the low/forward setting, while FIGS. 2B and 2C are top views of the high/forward and low/reverse settings respectively. Selection member 24 is shown with spaced annular structure 26, in approximately the position a bottom portion of the member occupies when those settings are selected.

In order to ensure that the desired mode is selected, flush sliding contact is established between selection member 24 and switches 14, 16 by providing both switches with concave contact surfaces 14*a*, 16*a* respectively, and member 24 with annular structure 26 which slides fittingly along the concave surfaces as shown.

Figure 3:
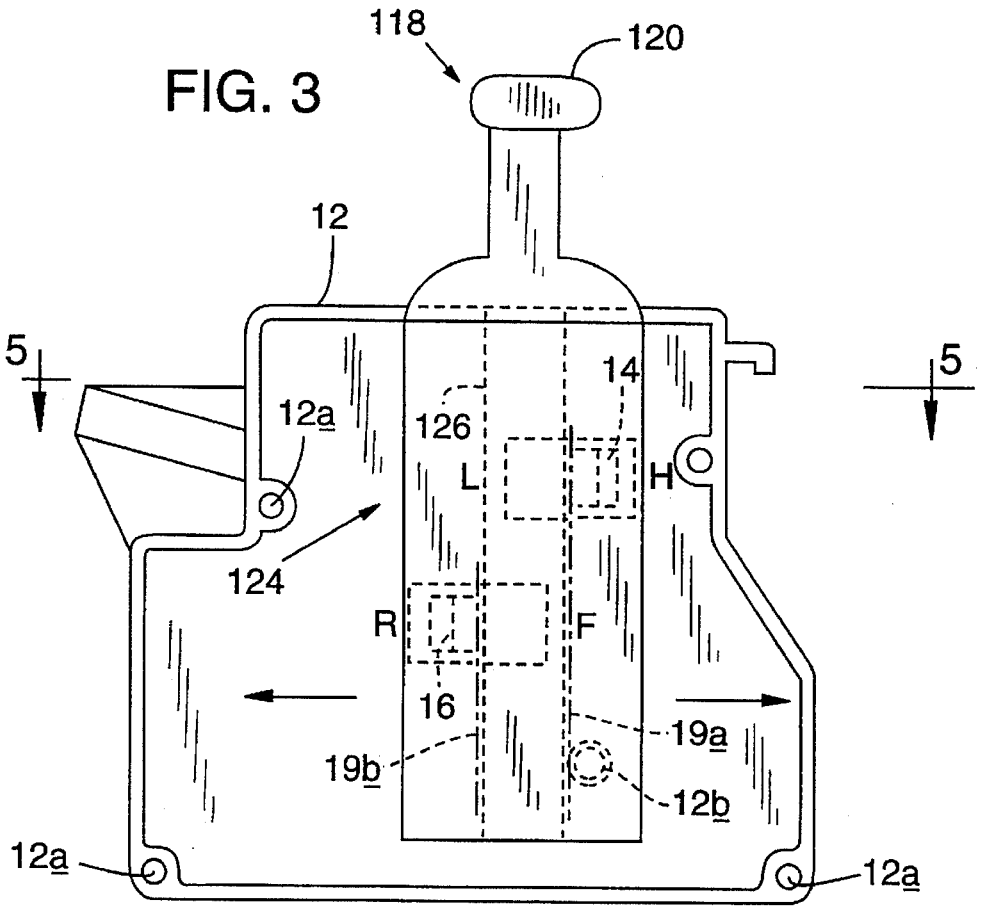
FIG. 3 is a side-plan view of an alternative embodiment of the present invention.

FIG. 3 shows an alternative embodiment in which housing 12 is suitably adapted to slidingly receive an actuator 118. As shown, actuator 118 includes a handle 120, a slide plate 124 connected to handle 120, and a selection member 126. Actuator 118 is suitably mounted adjacent switches 14, 16 on housing 12 and slidable in the directions indicated by the arrows, which directions are generally parallel to a plane defined by pivot axes 19*a*, 19*b*. Selection member 126 is preferably elongate and situated on the underside of slide plate 124 as viewed in FIG. 3. It will be appreciated that member 126 is also situated on actuator 118 transverse the slide path (indicated by the arrows) of the actuator. Rocker switches 14, 16 are the same as described above and member 126 has a rounded bottom portion (FIG. 5) for sliding along the concave contact surfaces to ensure that the appropriate speed and direction is selected when a child moves handle 120.

Figure 4:
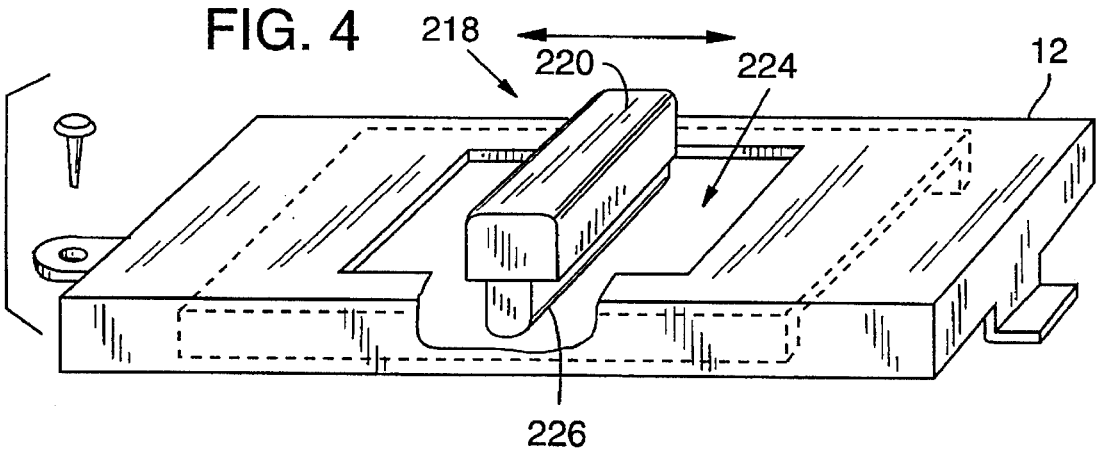
FIG. 4 is an isometric view of another alternative embodiment of the shifter with a portion broken away to show detail.
Figure 5:
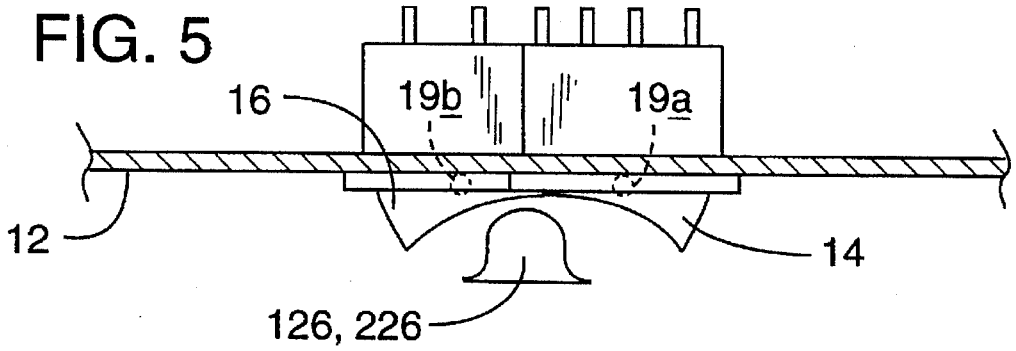
FIG. 5 is a top-sectional view of the alternative embodiment similar to the view in FIG. 2A, taken generally along line 5—5 in FIG. 3.

FIG. 4 shows another alternative embodiment in which an actuator 218 includes an elongate handle 220 attached to a slide plate 224. An elongate selection member 226, similar to member 126, is joined to the bottom of slide plate 224 and extends transversely of the slide path indicated by the double-headed arrow directly above handle 220. FIG. 5 is similar to FIG. 2A and shows the spatial relation between selection members 126, 226 and switches 14, 16.

Like actuator 18 which is pivotable between plural contact positions, actuators 118, 218 are slidable between a plurality of contact positions including a first contact position corresponding to low/forward, a second contact position corresponding to high/forward, and a third contact position corresponding to low/reverse.

FIG. 6 shows a simplified schematic diagram of the electrical system of the assembly at 40. It will be understood that system 40 may be employed in each of the embodiments described above. System 40 includes a motor source in the form of motors 42, 44 connected to speed switch 14 which is in turn connected to direction switch 16. Direction switch 16 is connected to a battery source 48, such as a 12- or 18-volt battery source and the system is enabled by an on/off switch 46 which may be a single-pole, double-throw switch. A resister 47 is provided for dynamically braking the vehicle when the on/off switch is turned to the "off" position. On/off switch 46 may be tied to a foot peddle on the floor or a switch actuated by the child's finger. When switch 46 is moved to the "on" position, the circuit is completed and current is allowed to flow through direction switch 16 and speed switch 14 to power motors 40, 42.

In FIG. 6, the speed and direction switches have been set to the low/forward mode. The low/reverse setting is achieved by setting direction switch 16 to its reverse setting (R) which reverses the polarity of the battery source and hence the direction of the motors. Similarly, high/forward is achieved by setting speed switch 14 to its alternate setting (H) which switches motors 40, 42 in parallel for high speed operation. While it is possible to manually set the switches to a high speed reverse mode when the shifter is disassembled, it is mechanically impossible to do so when the shifter is in place in a ride-on toy because of the physical positioning of switches 14, 16 in relation to selection members 24, 126, 226 described above.

In operation, the shifter assembly is designed to be mounted on the body of a child's ride-on vehicle. The vehicle may have one or more batteries or power source and one or more motors connected to the vehicle's wheels. The assembly employs two rocker switches mounted on the housing and connected between the motor or motors and the power source. An actuator allows a child sitting on or within the vehicle to select between desired speeds and directions.

Preferably the housing and actuator are made from molded plastic which is both inexpensive and durable to withstand the uses to which it may be subjected. The housing is provided with a preferably chamfered aperture so that a parent may insert a stop element to establish a high-speed lockout and prevent a child from moving the actuator to select the high/forward mode until safe operation of the vehicle is learned at slower speeds. The assembly's housing is mounted directly on the vehicle's body where it may be easily manipulated by a child rider. By moving the actuator throughout the various settings discussed above, the child may cause the vehicle to be operated at different speeds and directions.

While the present invention has been shown and described with reference to the foregoing preferred embodiments, it is to be understood by those skilled in the art that other changes in form and detail may be made therein without departing from the spirit and scope of the invention as defined in the appended claims.

It is claimed and desired to secure by Letters Patent:

1. In a riding vehicle having a battery source, a motor source, a vehicle body and wheels rotatably connected to the vehicle's body, a shifter assembly mounted to the vehicle's body and connected between the battery source and the motor source for selecting speed and direction comprising:

a speed switch movable about a pivot axis between a high and a low setting;

a direction switch adjacent the speed switch, movable about a pivot axis between a forward and a reverse setting; and an actuator positioned adjacent the speed and direction switches, movable in a plane generally parallel to the pivot axes of the speed and direction switches, for selectively contacting the switches to cause the speed switch to pivot between its low and high settings when the direction switch is in its forward setting and to cause the direction switch to pivot between its forward and reverse settings when the speed switch is in its low setting, each switch remaining in either of its settings until acted upon by the actuator to cause the switch to pivot to its other setting, where it remains until the actuator again acts upon it to cause the switch to pivot back to its first setting.

2. The assembly of claim 1, wherein the actuator is pivotable about an axis generally perpendicular to the pivot axes of the speed and direction switches.

3. The assembly of claim 1, wherein the actuator is slidable in a direction generally parallel to a plane defined by the pivot axes of the speed and direction switches.

4. The assembly of claim 2, wherein the actuator is pivotable between a plurality of positions to a first contact position corresponding to low forward, a second contact position corresponding to high low/forward, and a third contact position corresponding to low/reverse, the speed and direction switches remaining in a selected contact position until the actuator engages at least one of the switches to cause it to pivot to another of the contact positions.

5. The assembly of claim 4, wherein the speed and direction switches are rocker switches.

6. The assembly of claim 5, wherein the speed and direction switches have concave contact surfaces and wherein the actuator includes an elongate depending member having longitudinal-spaced annular structure thereon for contacting the concave contact surfaces of the switches.

7. The assembly of claim 3, wherein the actuator is slidable between a plurality of contact positions to a first contact position corresponding to low forward, a second contact position corresponding to a high/forward, and a third contact position corresponding to low/reverse, the speed and direction switches remaining in a selected contact position until the actuator engages at least one of the switches to cause it to pivot to another of the contact positions.

8. The assembly of claim 3, wherein the actuator includes an elongate selection member having longitudinally-spaced annular structure thereon for contacting the switches extending transversely of the actuator's direction of movement.

9. The assembly of claim 8, wherein the switches are rocker switches having concave contact surfaces.

10. The assembly of claim 2, wherein the pivot axes of the speed switch and the direction switch are spaced-apart from each other and generally parallel.

11. The assembly of claim 3, wherein the pivot axes of the speed switch and the direction switch are spaced-apart from each other and generally parallel.

* * * * *